US011604041B1

(12) United States Patent
Alexander et al.

(10) Patent No.: US 11,604,041 B1
(45) Date of Patent: Mar. 14, 2023

(54) SEMI-AUTOMATIC PISTOL HAVING SAFETY LOCKOUT ON DISCONNECTOR

(71) Applicant: Kimber IP, LLC, Troy, AL (US)

(72) Inventors: Aaron Alexander, Troy, AL (US); Eric Comstock, Troy, AL (US); Thomas Mercier, Troy, AL (US)

(73) Assignee: Kimber IP, LLC, Troy, AL (US)

( * ) Notice: Subject to any disclaimer, the term of this patent is extended or adjusted under 35 U.S.C. 154(b) by 0 days.

(21) Appl. No.: 17/573,355

(22) Filed: Jan. 11, 2022

(51) Int. Cl.
*F41A 17/72* (2006.01)

(52) U.S. Cl.
CPC ..... *F41A 17/72* (2013.01)

(58) Field of Classification Search
CPC ..... F41A 17/72; F41A 19/10; F41A 19/28
See application file for complete search history.

(56) References Cited

U.S. PATENT DOCUMENTS 2,846,925 A * 8/1958 Norman ..... F41A 17/38 89/196
3,577,827 A * 5/1971 Billett ..... F41A 19/16 89/148
4,023,296 A * 5/1977 Frisoli ..... F41A 19/42 42/69.03
5,386,659 A * 2/1995 Vaid ..... F41A 19/32 42/69.02
5,705,763 A * 1/1998 Leon ..... F41A 19/33 89/128
6,412,206 B1 * 7/2002 Strayer ..... F41A 19/12 42/69.03
7,827,720 B1 * 11/2010 Erdem ..... F41A 17/42 42/70.08
8,590,200 B2 * 11/2013 Domian ..... F41A 17/36 42/70.01
9,689,635 B2 * 6/2017 Krieger ..... F41A 17/64
(Continued)

*Primary Examiner* — Michelle Clement
(74) *Attorney, Agent, or Firm* — Kaplan Breyer Schwarz, LLP

(57) ABSTRACT

A disconnector trigger bar safety for a semi-automatic pistol is provided and includes a trigger bar having a firing pin end having a sear surface and a cam surface. The trigger bar has an inside surface disposed adjacent to the cam surface. A disconnector is moveable from an inward position to an outward position and has a cam surface to receive the cam surface of a trigger bar. An inset portion is provided on the trigger bar at the firing pin end that has a bottom surface. A protuberance on the side of the disconnector is provided to mate with the inset portion of the trigger bar. The protuberance has a top surface matable to the bottom surface of the inset portion. Rearward movement of the trigger bar causes the cam surface of the trigger bar to slide against the cam surface of the disconnector to move the firing pin end of the trigger bar downwardly. The disconnector moves to provide clearance for the trigger bar to move upward. The top surface of the protuberance mates with the bottom portion of inset portion of the trigger bar to prevent downward movement of the trigger bar. Forward movement of the trigger bar causes the top surface of the disconnector to disengage from the bottom portion of the inset portion of the trigger bar and causes the disconnector to move to allow the cam surface of the trigger bar to reengage with the cam surface of the disconnector.

2 Claims, 15 Drawing Sheets

(56) References Cited

U.S. PATENT DOCUMENTS

| | | | | |
|---|---|---|---|---|
| 10,126,082 | B2 * | 11/2018 | Hudson, III | F41A 19/10 |
| 10,234,225 | B2 * | 3/2019 | Zukowski | F41A 17/20 |
| 10,309,742 | B1 * | 6/2019 | Viani | F41A 19/12 |
| 10,739,095 | B2 * | 8/2020 | Underwood | F41A 17/28 |
| 10,871,339 | B2 * | 12/2020 | Elftmann, Jr. | F41A 19/14 |
| 11,274,892 | B2 * | 3/2022 | Franssen | F41A 17/58 |
| 2021/0071975 | A1 * | 3/2021 | Elftmann, Jr. | F41A 19/10 |
| 2022/0316829 | A1 * | 10/2022 | Vaughan | F41A 3/68 |
| 2022/0325971 | A1 * | 10/2022 | Bray | F41A 19/44 |

* cited by examiner

SEMI-AUTOMATIC PISTOL HAVING SAFETY LOCKOUT ON DISCONNECTOR

BACKGROUND OF THE INVENTION

The present invention is directed to safeties for semi-automatic pistols. More particularly, the present invention is directed to internal safeties for semiautomatic pistols to prevent improper movement of the trigger bar during a firing sequence of the pistol.

Current semi-automatic pistol designs have a disconnector disposed in the frame of the pistol that provides for resetting of the trigger bar after the pistol has fired so the trigger bar can engage the firing pin and place the firing pin in its ready position such that the pistol can be fired again. Current semi-automatic pistol disconnector design does not contain a safety feature to prevent the firing pin from bouncing off the trigger bar or prevent the firing pin from pushing the trigger bar out of the way when the firing pin is moved to the seared position. Currently, safety features of this type are built into other areas of the pistol, usually molded into a surface on the frame.

During a firing sequence, when a slide of the semi-automatic pistol is traveling forward stripping a cartridge from the pistol's magazine, it is also moving the firing pin forward to cause the firing pin sear surface to load against the trigger bar sear surface. It is at this point that the firing pin can potentially push the trigger bar sear surface down allowing the firing pin to skip over the trigger bar and travel forward, firing the pistol. While this is normally operable, a shortfall is that this system relies on another feature in the frame to prevent the trigger bar from falling. Another problem is that it requires the trigger bar have a complete travel to stay in a safe zone.

FIG. 1 shows a portion of a prior art pistol 100 having a trigger bar safety. The pistol 100 has a polymer molded frame 102. The frame 102 is shown with its trigger bar 104 in a fired position. At point A, the trigger bar 104 and frame 102 make contact. This contact keeps the trigger bar 104 in its "up" position when the sear of the pistol 100 is loading up on the trigger bar 104 (not shown), thus preventing the firing pin (also not shown) from slipping by the sear.

Similarly, FIG. 2 depicts a portion of another prior pistol 110 having a different trigger bar safety. The safety is activated by having its trigger bar 112 ride up a curvature 114 molded into its frame 116 at the grip 118, touching at point B, thereby keeping the trigger bar 112 from being pushed down out of the way during sear up.

It would be beneficial to provide a pistol safety having similar function, but that does not require surfaces of the molded frame to achieve this function.

SUMMARY OF THE INVENTION

In a first exemplary embodiment of the present invention, a semi-automatic pistol having a disconnector trigger bar safety is provided. The pistol includes a frame having a longitudinal axis, two sides and an upper surface, a trigger, a firing pin having a sear surface, a trigger bar, a disconnector and a slide. The trigger bar has a trigger end disposed at the trigger and a firing pin end having a sear surface and a cam surface. The trigger bar has an inside surface disposed adjacent to the cam surface. The disconnector is disposed in the frame and has at least one side generally parallel to one of the sides of the frame and is moveable perpendicular to the longitudinal axis of the frame from an inward position to outward position and back to the inward position. The disconnector has a cam surface to receive the cam surface of the trigger bar. The slide has a cam surface and is slidably mounted to the upper surface of the frame.

During a firing sequence of the pistol, the trigger bar moves rearward by rearward movement of the trigger to disengage the sear surface of the firing pin from the sear surface of the trigger bar to cause the firing pin to move forward to fire the pistol. The slide moves rearward to eject a cartridge case, and subsequently moves forward to supply a new cartridge to a chamber of the pistol. During this movement of the slide, the cam surface of the slide contacts the cam surface of the disconnector to urge the disconnector from the outward position to the inward position and back to the outward position (during rearward movement of the slide), and to urge the disconnector from the outward position to the inward position and back to the outward position (during forward movement of the slide).

The disconnector trigger bar safety includes an inset portion on the trigger bar at the firing pin end. The inset portion has bottom surface. The disconnector trigger bar safety further includes a protuberance on the at least one side of the disconnector to mate with the inset portion of the trigger bar. The protuberance has a top surface matable to the bottom surface of the inset portion.

During the firing sequence of the pistol, rearward movement of the trigger bar (by a user of the pistol pulling the trigger) causes the cam surface of the trigger bar to slide against the cam surface of the disconnector to move the firing pin end of the trigger bar downwardly to cause the sear surface of the trigger bar to release the firing pin to fire the pistol. Subsequent to firing, when the slide moves rearward, the disconnector moves to provide clearance for the trigger bar to move upward. When the slide moves forward, the slide causes the disconnector to move from the outward position to an inward position to a partially outward position, wherein the top surface of the protuberance of the disconnector mates with the bottom portion of inset portion of the trigger bar to prevent downward movement of the trigger bar. Forward movement of the trigger bar (by a user of the pistol releasing the trigger) causes the top surface of the disconnector to disengage from the bottom portion of the inset portion of the trigger bar and causes the disconnector to move to a fully outward position to allow the cam surface of the trigger bar to reengage with the cam surface of the disconnector.

In a second exemplary embodiment of the present invention, a disconnector trigger bar safety for a semi-automatic pistol is provided. The safety includes a trigger bar having a trigger end and a firing pin end. The firing pin end has a sear surface and a cam surface. The trigger bar has an inside surface disposed adjacent to the cam surface. The safety further includes a disconnector moveable from an inward position to outward position and has a cam surface to receive a cam surface of a trigger bar. An inset portion is provided on the trigger bar at the firing pin end. The inset portion has a bottom surface. The disconnector includes a protuberance on one side of the disconnector to mate with the inset portion of the trigger bar. The protuberance has a top surface matable to the bottom surface of the inset portion of the trigger bar.

Rearward movement of the trigger bar causes the cam surface of the trigger bar to slide against the cam surface of the disconnector to move the firing pin end of the trigger bar downwardly. A side of the disconnector slides against the inside surface of the trigger bar to allow the trigger bar to move upward. The top surface of the protuberance of the disconnector mates with the bottom portion of the inset portion of the trigger bar to prevent downward movement of the trigger bar. Forward movement of the trigger bar causes the top surface of the disconnector to disengage from the bottom portion of the inset portion of the trigger bar and causes the disconnector to move to allow the cam surface of the trigger bar to reengage with the cam surface of the disconnector.

DETAILED DESCRIPTION

The present invention is directed to a pistol disconnector that integrates a trigger bar and a disconnector to create a trigger bar safety. Surfaces in the disconnector and trigger bar prevent the trigger bar from being improperly pushed when the firing pin is "searing up" (i.e., when the firing pin loads against the trigger bar to move to a ready-to-fire configuration) when the slide is moving forward into battery. The present invention eliminates the need for a similar safety feature that utilizes a feature that is molded into the pistol's frame. The safety lockout of the present invention physically locks the trigger bar in its up position, ensuring that the firing pin cannot push past the trigger bar, keeping the trigger bar locked safely until the trigger is released. By using the disconnector for the trigger bar safety, improvements in the manufacturing of the pistol, including improving tolerancing stack up issues involved with multiple separate parts, are possible, since the safety is provided at the trigger bar and disconnector interface rather than at separate areas of the frame. Because the safety is integral with the disconnector, the present invention also allows for a shorter trigger pull without reducing safety. If the trigger is pulled just far enough to fire, but is not pulled completely, the safety lockout remains operational.

Figure 6:
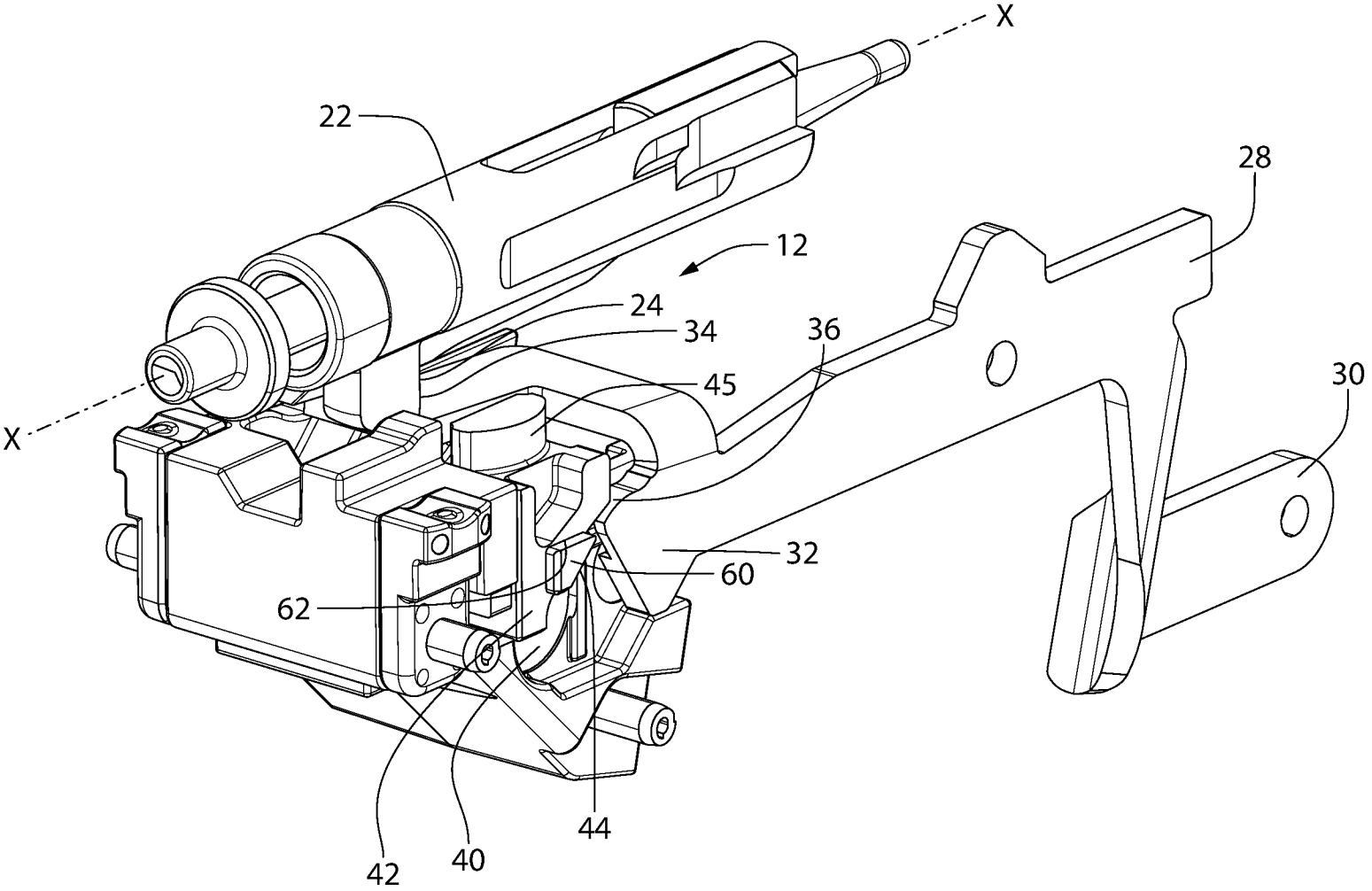
FIG. 6 is a partial side, isometric view of a trigger bar and disconnector of the pistol having the trigger bar disconnector safety of FIG. 3, shown in a first position, with its disconnector in an outward position and with the trigger bar in a ready to fire position.
Figure 7:
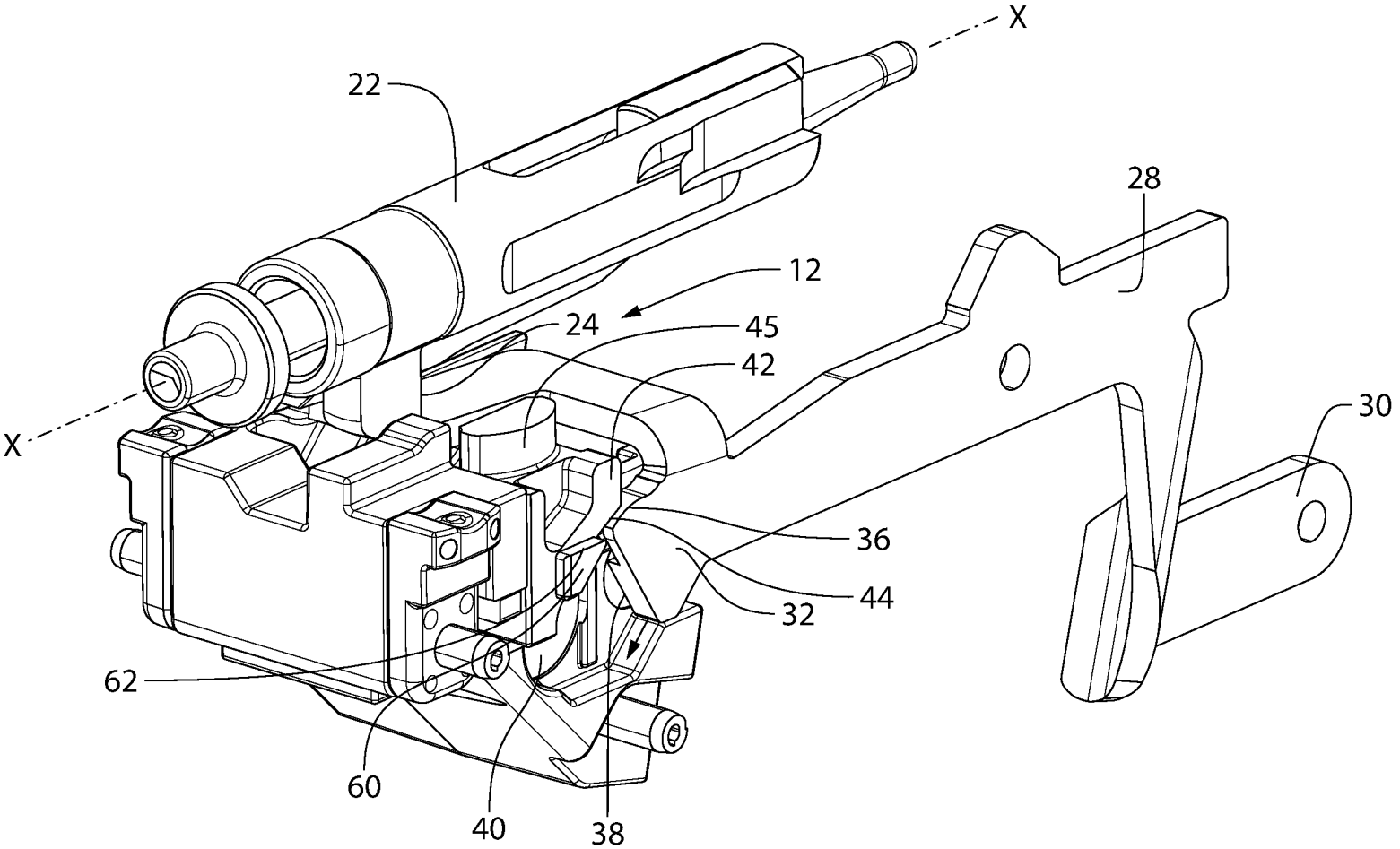
FIG. 7 is a partial side, isometric view of a trigger bar and disconnector of the pistol having the trigger bar disconnector safety of FIG. 3, shown in a second position as its trigger is initially being pulled by a user, with its disconnector in the outward position.

Referring now to the drawing figures wherein like part numbers refer to like elements throughout the several views, there is shown in FIG. 3-14 a semi-automatic pistol 10 having a disconnector safety 12 in accordance with an exemplary embodiment of the present invention. The pistol 10 has a longitudinal axis X and includes a frame 14. The frame 14 has two sides 16 and an upper surface 18. The pistol 10 further includes a trigger 20, a firing pin 22 having a sear surface 24, a trigger bar 28 having a trigger end 30 and a firing pin end 32. The trigger end 30 of the trigger bar 28 is disposed at the trigger 20. The trigger bar 28 has a sear surface 34 and a cam surface 36 at its firing pin end 32. The trigger bar 28 has an inside surface 38 disposed adjacent to the cam surface 36. The pistol 10 further includes a disconnector 40 disposed in the frame 14 wherein the disconnector 40 has at least one side 42 generally parallel to one of the sides 16 of the frame 14 and is moveable perpendicular to the longitudinal axis X during a firing sequence of the pistol 10. During the firing sequence, the disconnector 40 is first at a fully outward position (FIG. 6). Upon pressing of the trigger 20 by an operator of the pistol 10, the disconnector 40 moves to a partially inward position (FIGS. 9), to a fully inward position (FIG. 10), back to partially inward position (FIGS. 12-14) and then back out to its outer position (FIG. 6). During this movement of the disconnector the relative positions of the trigger bar 28 and the firing pin 22 change in the usual manner of many prior art semi-automatic pistols.

Figure 1:
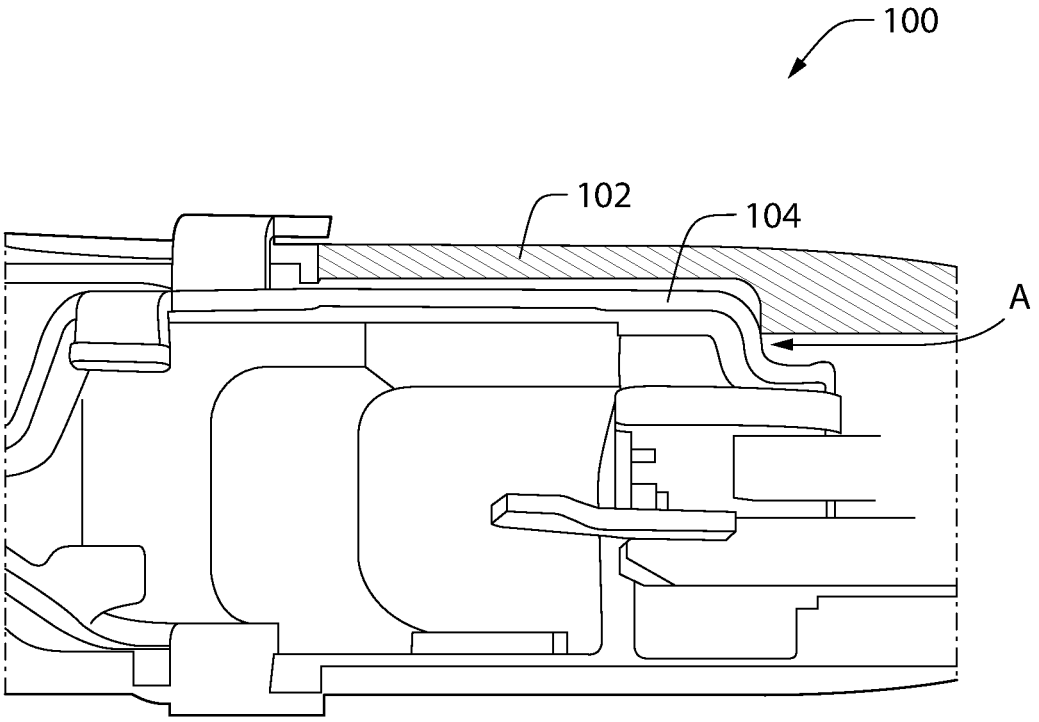
FIG. 1 (PRIOR ART)
FIG. 1 is a top, plan view of a frame, trigger bar and related components of a prior art semi-automatic pistol, with slide removed, depicting a prior art trigger bar safety.
Figure 2:
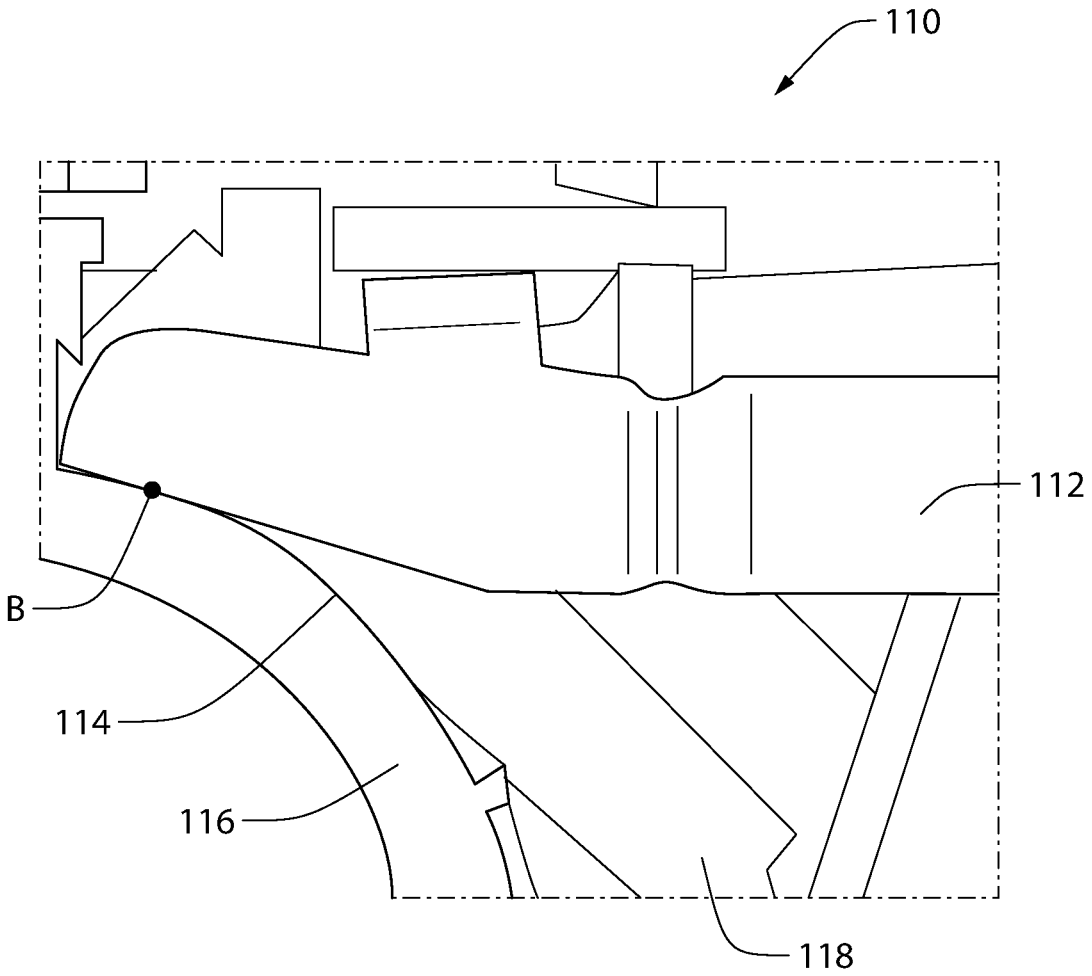
FIG. 2 (PRIOR ART)
FIG. 2 depicts a simplified cross-sectional side elevation view of a frame, trigger bar and related components of another prior art semi-automatic pistol, with slide removed, depicting another prior art trigger safety.
Figure 3:
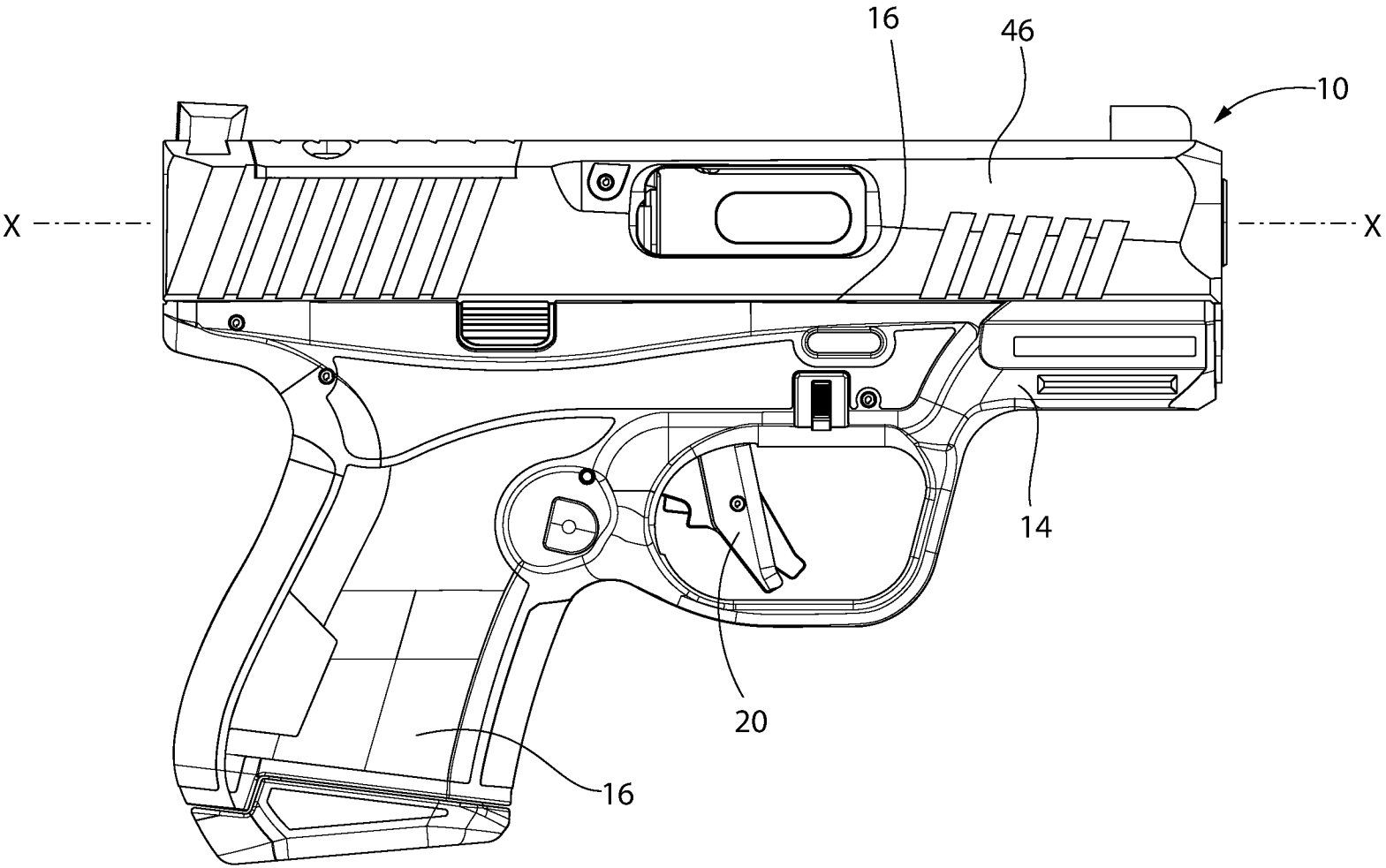
FIG. 3 depicts a side elevation view of a semi-automatic pistol having a trigger bar disconnector safety in accordance with an exemplary embodiment of the present invention.
Figure 4:
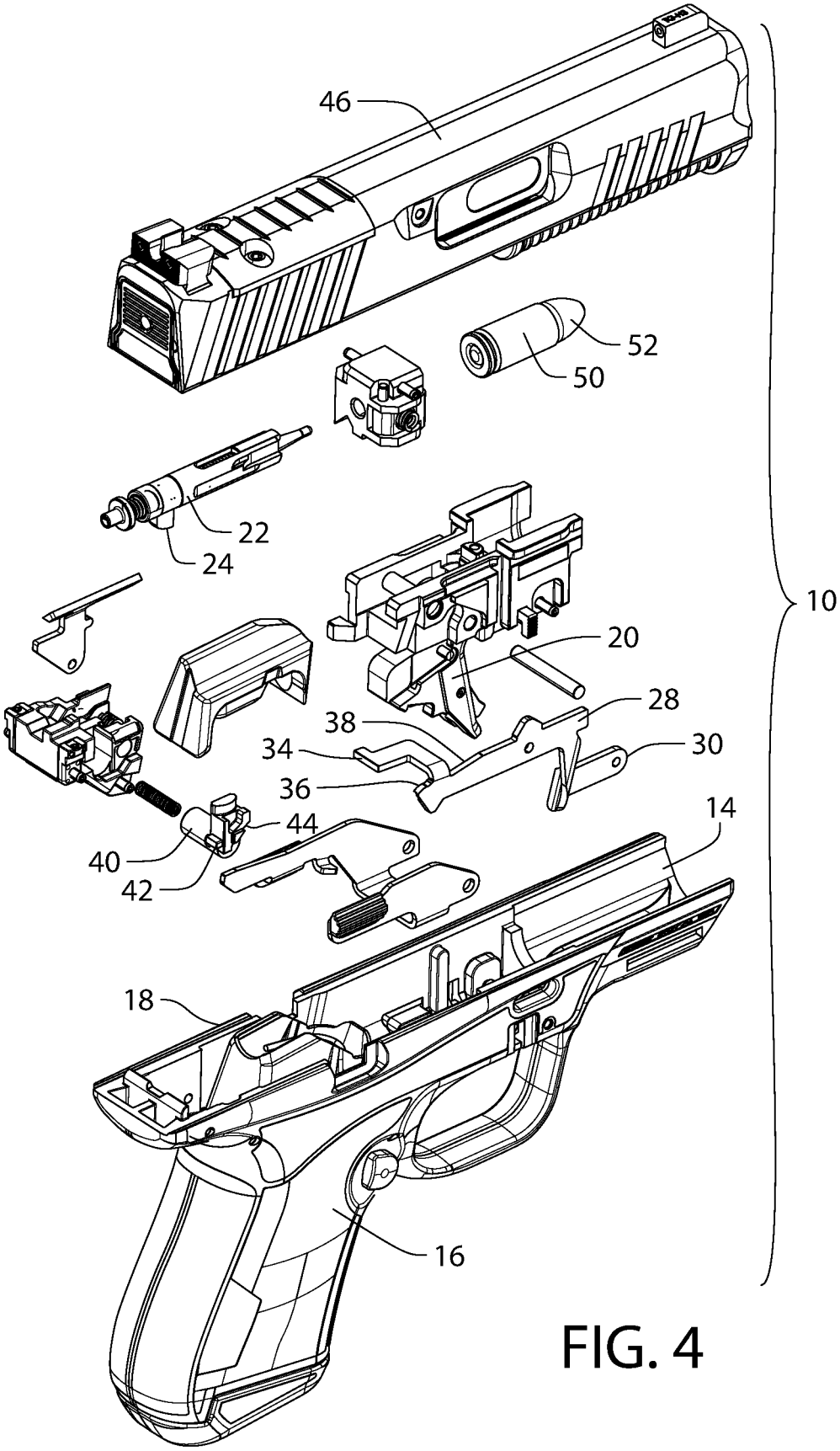
FIG. 4 is an exploded isometric view of the semi-automatic pistol having the trigger bar disconnector safety of FIG. 3.
Figure 4A:
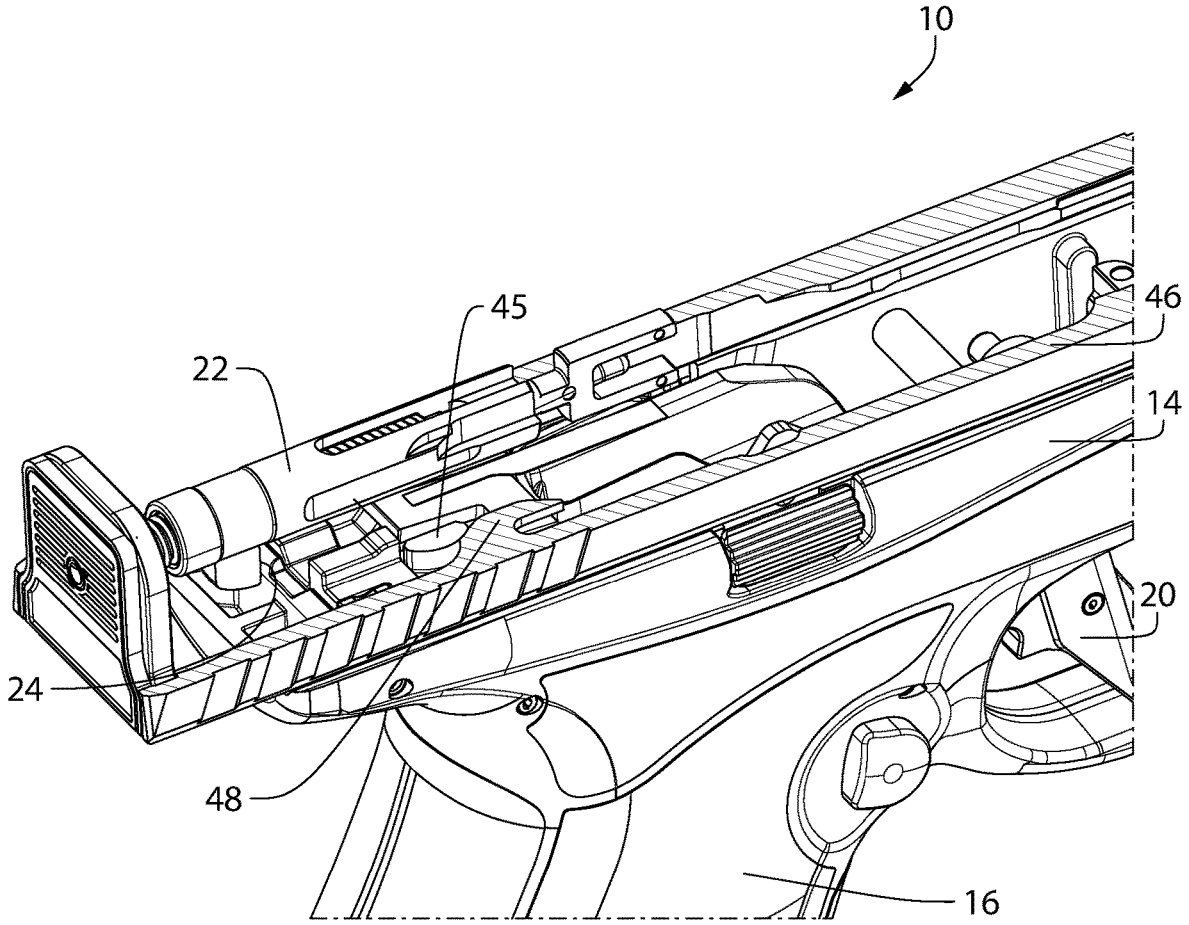
FIG. 4A is a top isometric view of the semi-automatic pistol having the trigger bard disconnector safety of FIG. 3, shown with a cut away view of its slide.
Figure 5:
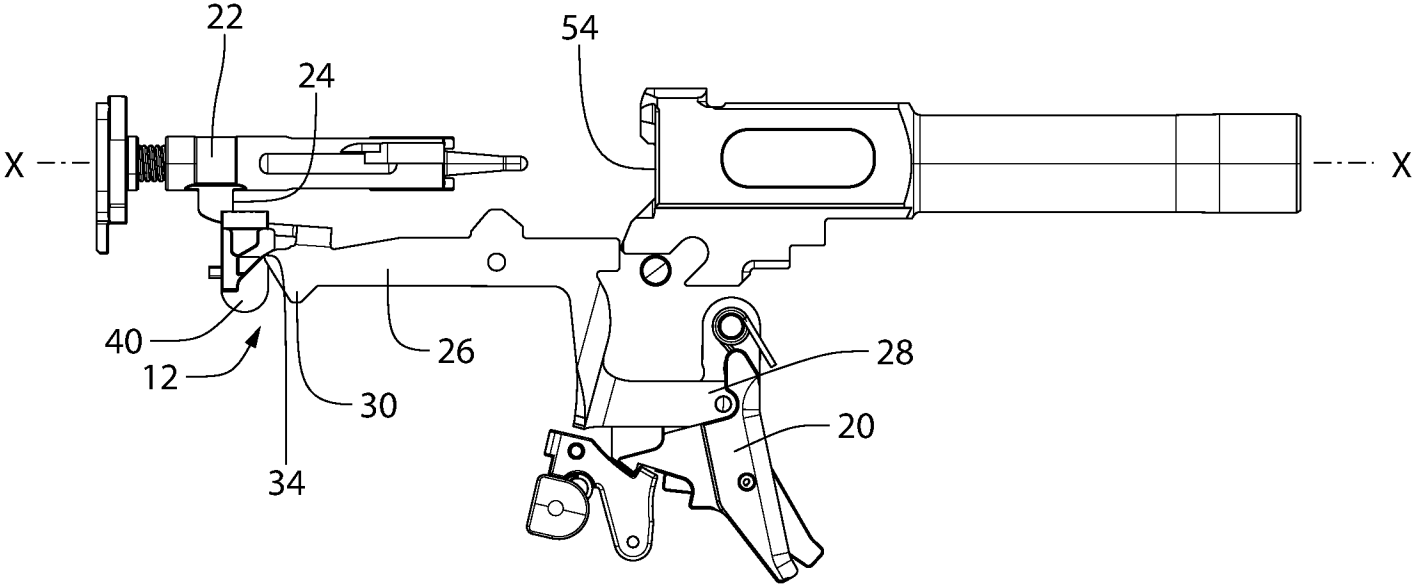
FIG. 5 is a side elevation view of a trigger, disconnector, firing pin, barrel and related components of the semi-automatic pistol having a trigger bar disconnector safety of FIG. 3, shown without a frame.

As can best be seen in FIG. 4, the disconnector 40 has a trigger bar cam surface 44 to receive the cam surface 36 of the trigger bar 28. The disconnector 40 also has a slide cam surface 45 to receive a slide cam surface 48 of the pistol's slide 46 (discussed below) (FIG. 4A). While semi-automatic pistol slides have many functional surfaces, including functional internal surfaces, as are well known in the art of semi-automatic pistols in general, the slide cam surface 48 is located internal to the slide 46 and is placed to move against the slide cam surface 45 of the disconnector 40. As is typical of many prior art semi-automatic pistols, the slide 46 is slidably mounted to the upper surface 18 of the frame 14 in a direction parallel to the longitudinal axis X of the pistol 10 during a firing sequence of the pistol 10. This movement of the slide 46 causes the slide cam surface 48 of the slide 46 to move against the slide cam surface 45 of the disconnector to cause the disconnector 40 to move in and out in a direction perpendicular to the longitudinal axis X of the frame 14 from the outward position to the inward position during a firing sequence of the pistol 10 (see FIG. 4A and generally FIGS. 6-14).

During the firing sequence of the pistol 10 as shown in FIGS. 6-14, in a manner typical of many prior art semi-automatic pistols, initially, the cam surface 36 of the trigger bar is engaged with the trigger bar cam surface 44 of the disconnector 40 (see FIG. 6). The trigger bar 28 moves rearward by initial rearward movement of the trigger 20 to disengage the sear surface 24 of the firing pin 22 from the sear surface 34 of the trigger bar 28 to cause the firing pin 22 to accelerate forward under the force of a firing pin spring to fire the pistol 10. See FIG. 7. Then, due to forces created when the pistol 10 is fired, the slide 46 begins its rearward movement that causes a cartridge case 50 to eject, and subsequently moves forward to supply a new cartridge 52 to a chamber 54 of the pistol 10. See FIG. 5. Upon firing of the pistol 10, the rearward movement of the slide 46 causes its cam surface 48 to contact the cam surface 45 of the disconnector 40 to urge the disconnector 40 from the fully outward position (FIG. 6) to a fully inward position (FIG. 10) and back to a fully outward position (FIG. 6) during rearward movement of the slide 46. Then, during forward movement of the slide 46, the disconnector 40 is again urged from the outward position (FIGS. 6-8) to a partially inward position (FIG. 9), to a fully inward position (FIG. 10) to the outward position.

In accordance with the present invention, the disconnector safety 12 first includes an inset portion 56 on the trigger bar 28 at the firing pin end 32 where the inset portion 56 has a bottom surface 58. The disconnector safety 12 of the present invention also includes a protuberance 60 on the side 42 of the disconnector 40 to mate with the inset portion 56 of the trigger bar 28. The protuberance 60 has a top surface 62 matable to the bottom surface 58 of the inset portion 56.

Figure 8:
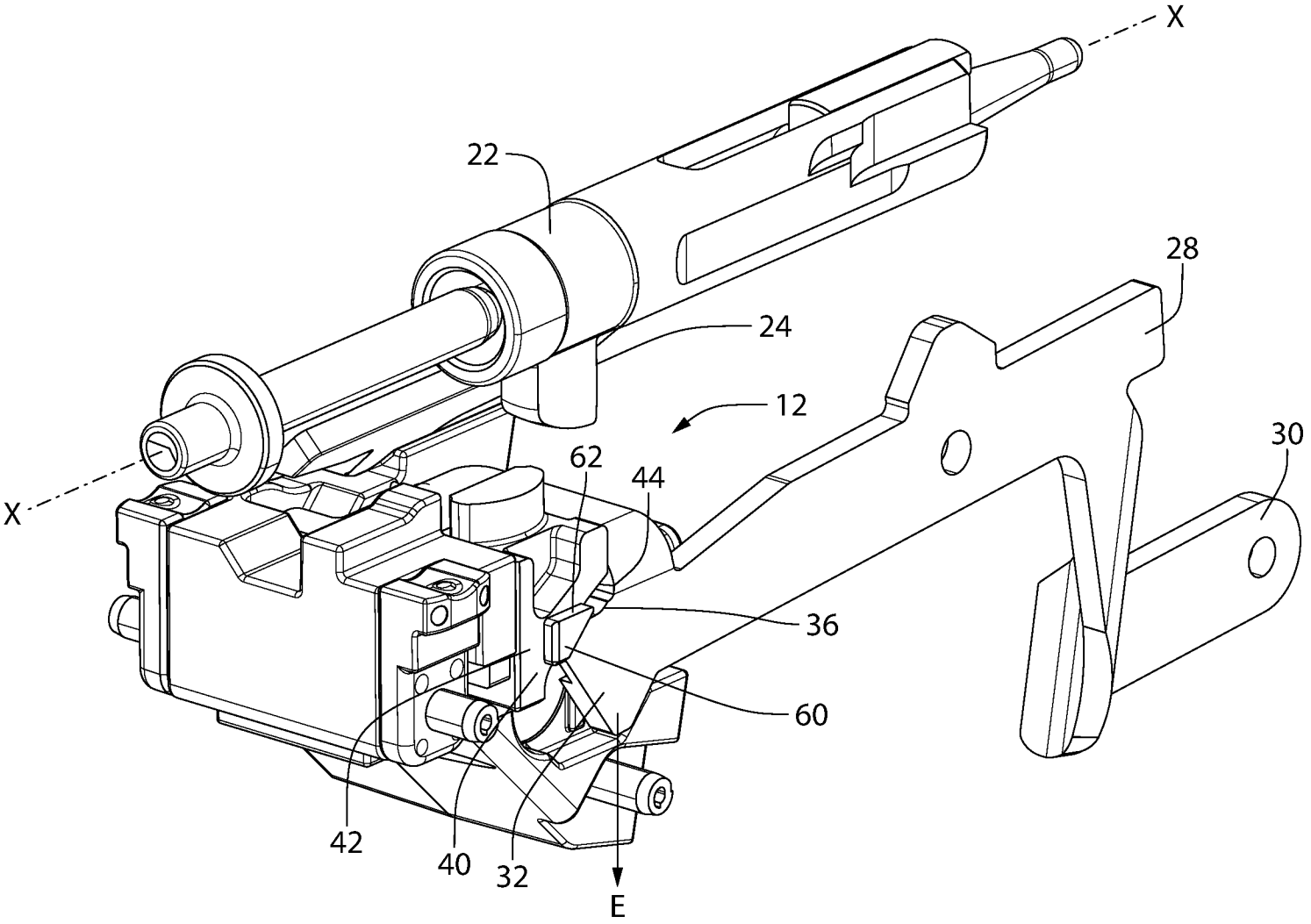
FIG. 8 is a partial side, isometric view of a trigger bar and disconnector of the pistol having the trigger bar disconnector safety of FIG. 3, shown in a third position, with its trigger bar in its full-back position and it's firing pin released, with the disconnector in the outer position.
Figure 9:
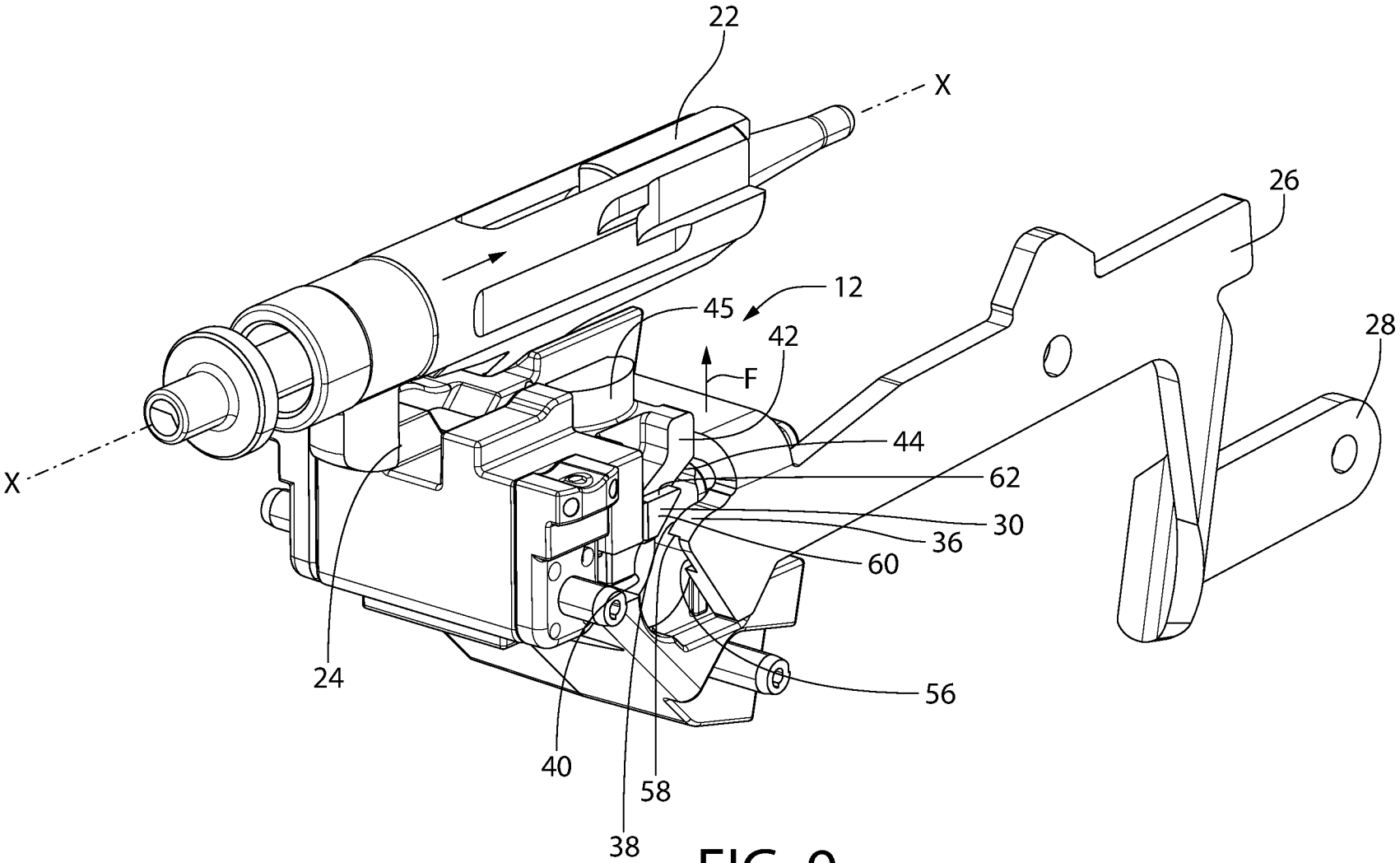
FIG. 9 is a partial side, isometric view of a trigger bar and disconnector of the pistol having the trigger bar disconnector safety of FIG. 3, shown in a fourth position, with its disconnector in a partially inward position due to cammed forces from the pistol's slide, and the end of the trigger bar in a downward most position.
Figure 10:
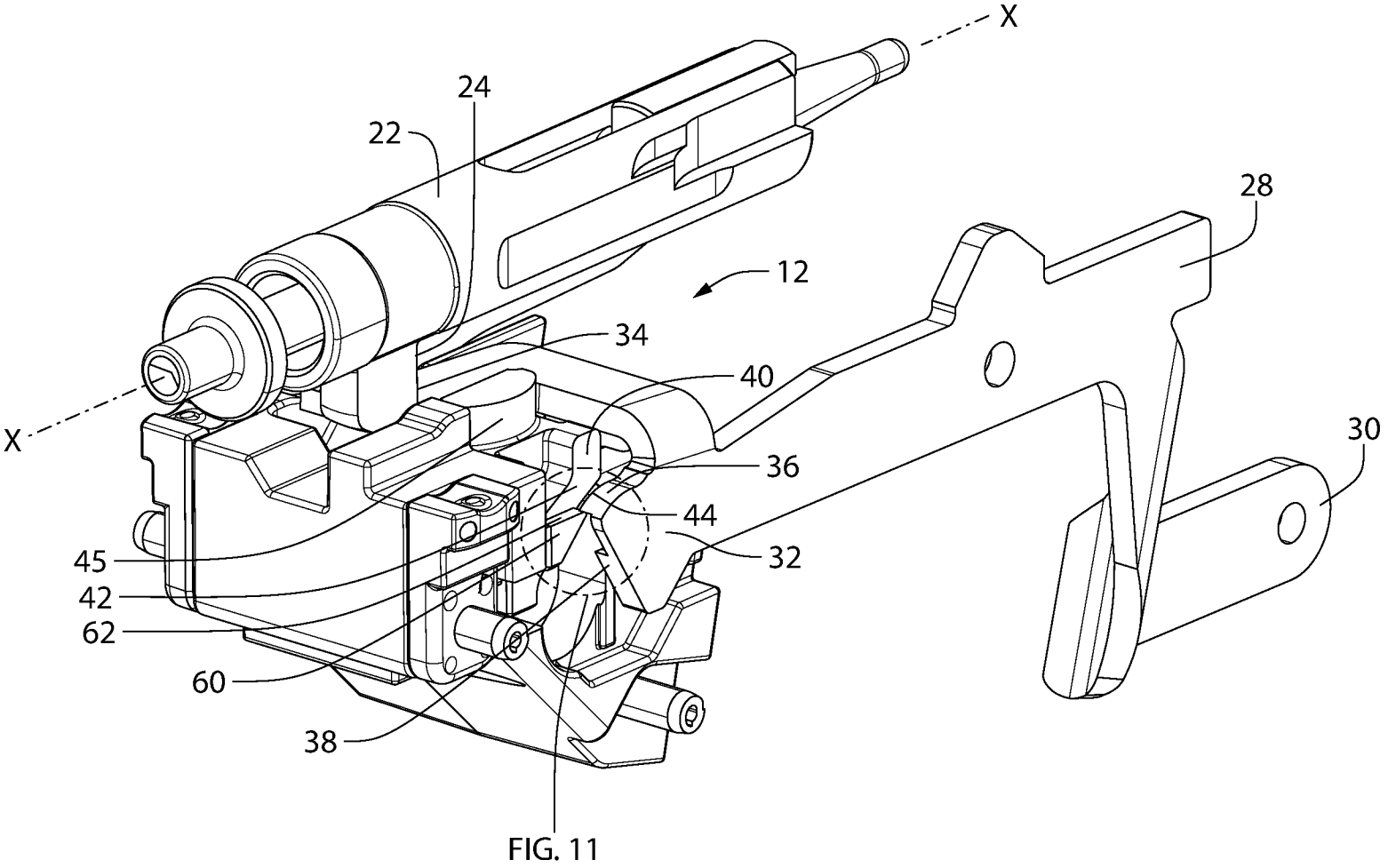
FIG. 10 is a partial side, isometric view of a trigger bar and disconnector of the pistol having the trigger bar disconnector safety of FIG. 3, shown in a fifth position, with its disconnector in a fully inward position, with the trigger bar travelling upward, and with the safety beginning to engage.
Figure 11:
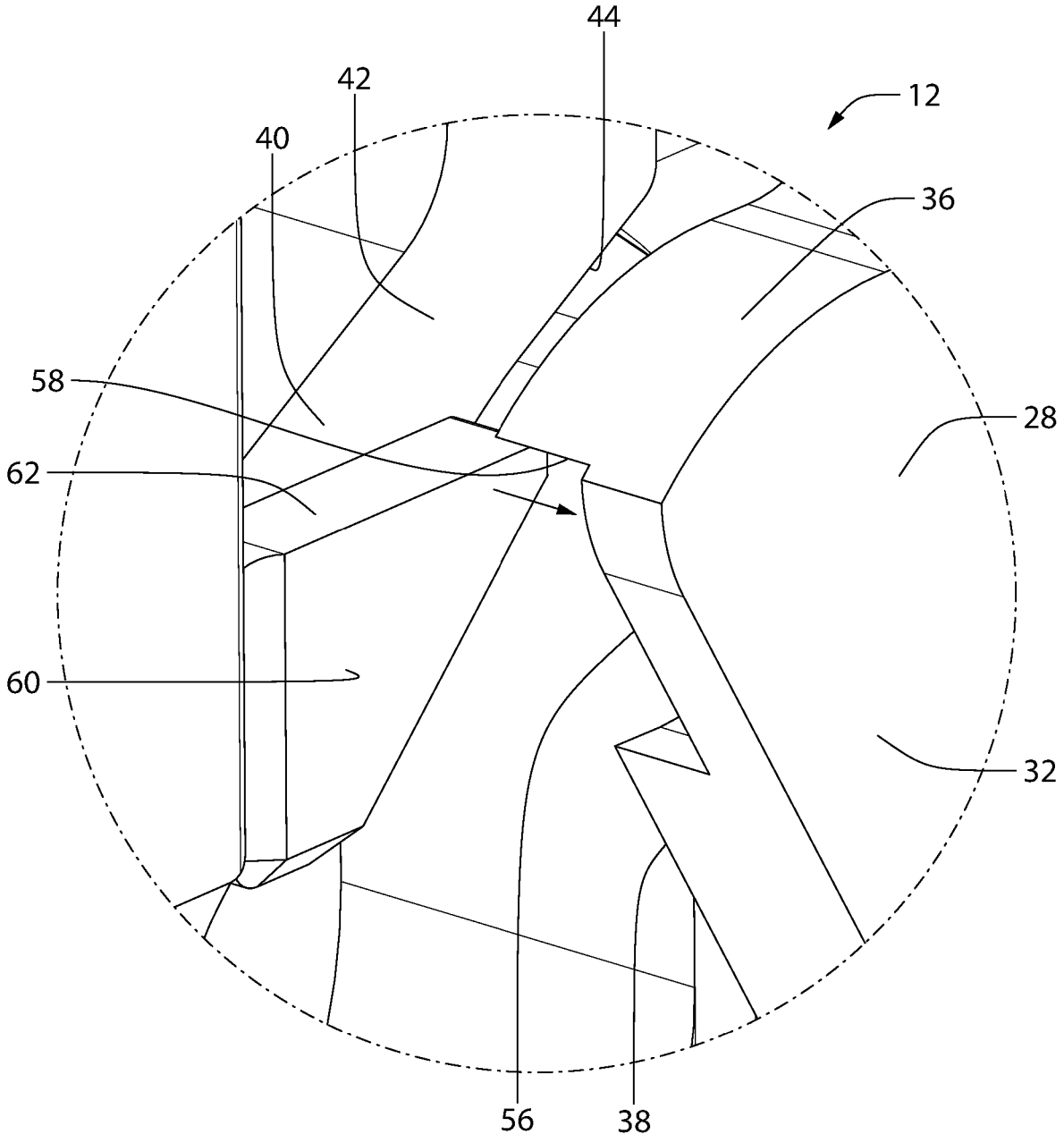
FIG. 11 is an enlarged, partial isometric view of a trigger bar and disconnector of the pistol having the trigger bar disconnector safety of FIG. 3, taken at detail "FIG. 11" of FIG. 10.
Figure 12:
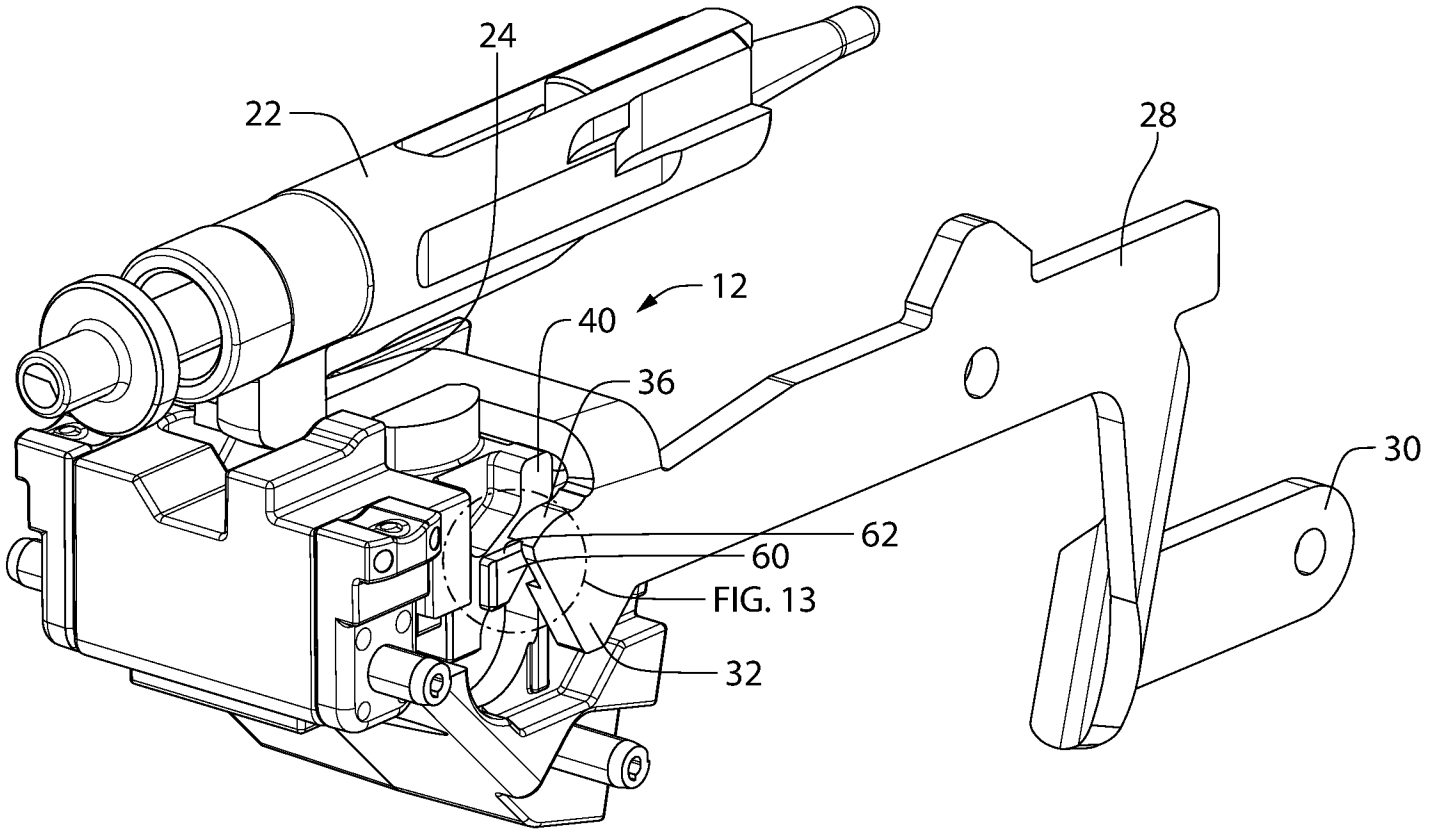
FIG. 12 is a partial side, isometric view of a trigger bar and disconnector of the pistol having the trigger bar disconnector safety of FIG. 3, shown in a sixth position with the disconnector in a partially inward position, and with the safety fully engaged.
Figure 13:
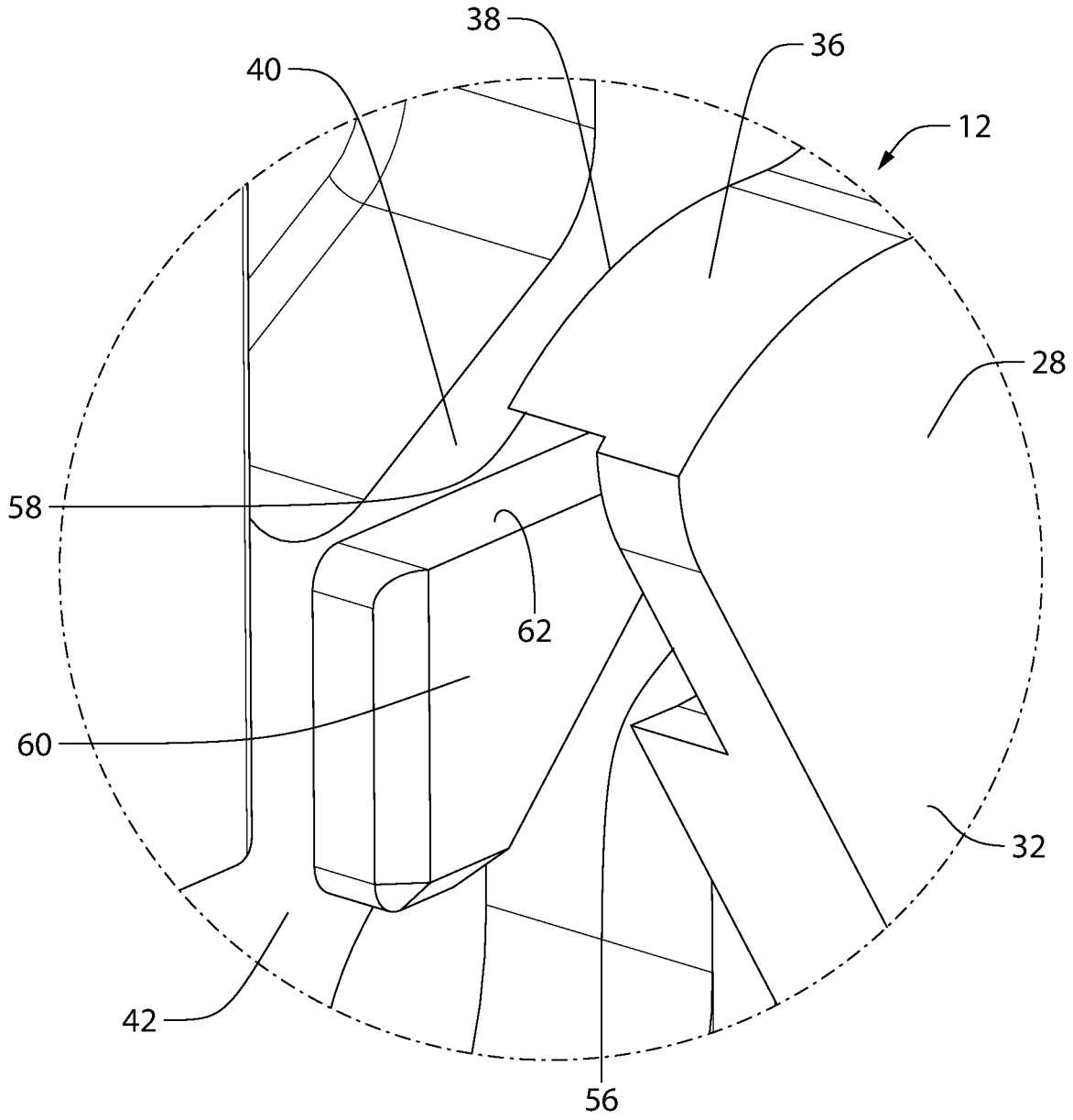
FIG. 13 is an enlarged, partial isometric view of a trigger bar and disconnector of the pistol having the trigger bar disconnector safety of FIG. 3, taken at detail "FIG. 13" of FIG. 12.
Figure 14:
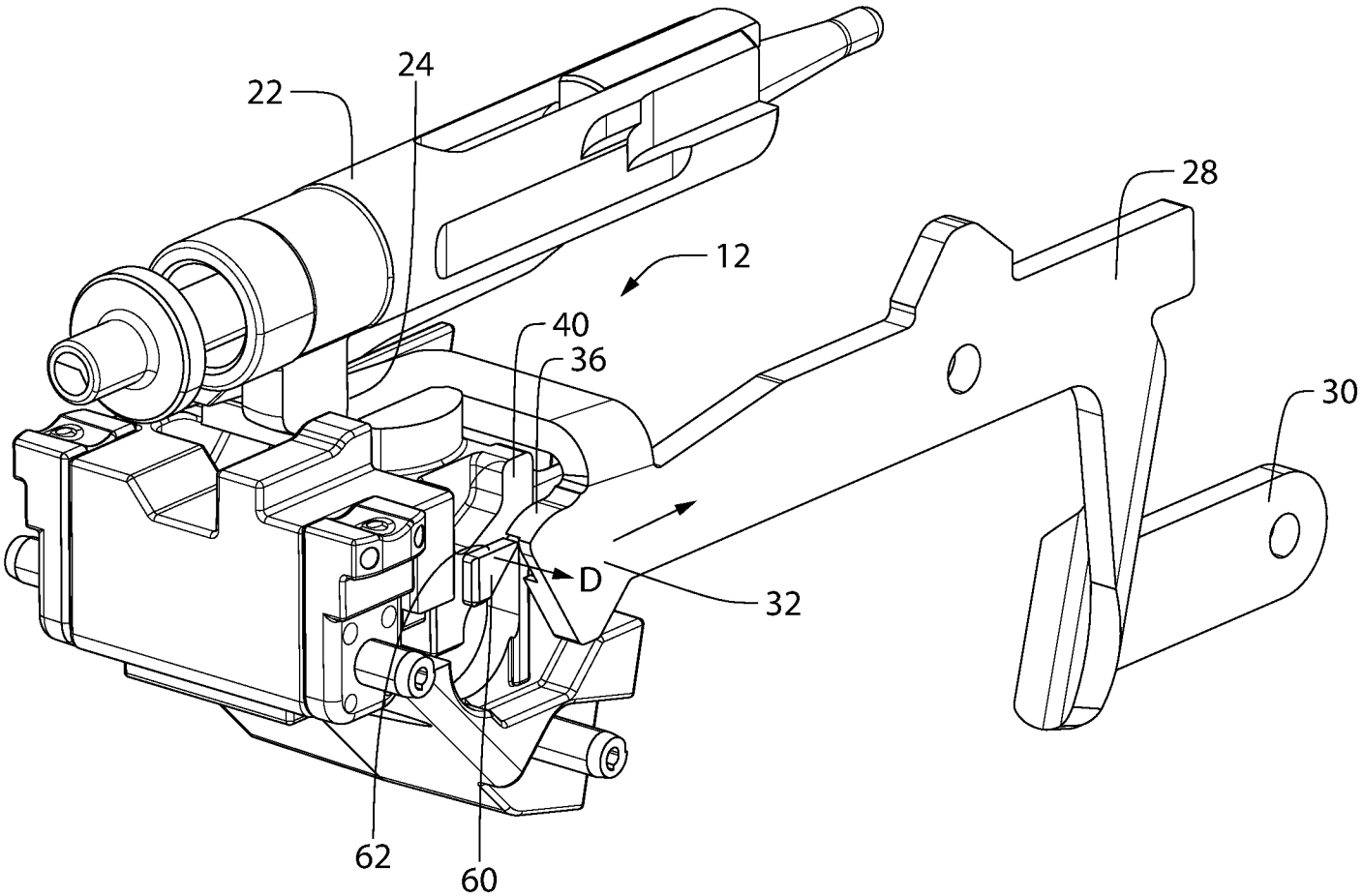
FIG. 14 is a partial side, isometric view of a trigger bar and disconnector of the pistol having the trigger bar disconnector safety of FIG. 3, shown in a seventh position with the disconnector in a partially inward position, with the trigger bar in a forward position due to release of the trigger with the safety disengaged.

During the firing sequence, rearward movement of the trigger bar 28 causes the cam surface 36 of the trigger bar 28 to slide against the cam surface 44 of the disconnector 40 to move the firing pin end 32 of the trigger bar 28 downwardly (FIG. 8; direction E) to cause the sear surface 34 of the trigger bar 28 to release the firing pin 22 to fire the pistol 10 (FIG. 8). When the slide 46 moves rearward, the disconnector 40 moves to provide clearance for the trigger bar 28 to move upward. (FIG. 9; direction F).

As the slide 46 moves forward, the slide 46 causes the disconnector 40 to move partially outward (FIG. 10), wherein the top surface 62 of the protuberance 60 of the disconnector 40 begins to mate (FIGS. 10 and 11) and then fully mates (FIGS. 12-13) with the bottom portion 58 of inset portion 56 of the trigger bar 28 to prevent downward movement of the trigger bar 28. Forward movement of the trigger bar 28 causes the top surface 62 of the disconnector 40 to disengage from the bottom portion 58 of the inset portion 56 of the trigger bar 28 (FIG. 14) and causes the disconnector 40 to move to a fully outward position to allow the cam surface 36 of the trigger bar 28 to reengage with the cam surface 44 of the disconnector 40 (i.e., back to the position of FIG. 6).

It is to be understood that the disclosure teaches just one example of the illustrative embodiment and that many variations of the invention can easily be devised by those skilled in the art after reading this disclosure and that the scope of the present invention is to be determined by the following claims.

What is claimed is:

1. A semi-automatic pistol having a disconnector trigger bar safety, the pistol comprising:

(a) a frame having a longitudinal axis, two sides and an upper surface, (b) a trigger, (c) a firing pin having a sear surface, (d) a trigger bar having a trigger end disposed at the trigger and a firing pin end having a sear surface and a cam surface, the trigger bar having an inside surface disposed adjacent to the cam surface, and (e) a disconnector disposed in the frame, the disconnector having at least one side generally parallel to one of the sides of the frame and moveable perpendicular to the longitudinal axis of the frame from an inward position to an outward position and back to the inward position, the disconnector having a cam surface to receive the cam surface of the trigger bar, (f) a slide having a cam surface and slidably mounted to the upper surface of the frame, wherein, during a firing sequence of the pistol:

the trigger bar moves rearward by rearward movement of the trigger to disengage the sear surface of the firing pin from the sear surface of the trigger bar to cause the firing pin to move forward to fire the pistol, the slide moves rearward to eject a cartridge case, and subsequently moves forward to supply a new cartridge to a chamber of the pistol, wherein the cam surface of the slide contacts the cam surface of the disconnector to urge the disconnector from the outward position to the inward position and back to the outward position during rearward movement of the slide, and to urge the disconnector from the outward position to the inward position and back to the outward position during forward movement of the slide, (g) wherein, the disconnector trigger bar safety comprises:

(i) an inset portion on the trigger bar at the firing pin end, the inset portion having a bottom surface, and (ii) a protuberance on the at least one side of the disconnector to mate with the inset portion of the trigger bar, the protuberance having a top surface matable to the bottom surface of the inset portion, wherein, during the firing sequence, rearward movement of the trigger bar causes the cam surface of the trigger bar to slide against the cam surface of the disconnector to move the firing pin end of the trigger bar downwardly to cause the sear surface of the trigger bar to release the firing pin to fire the pistol, wherein, when the slide moves rearward, the disconnector moves to provide clearance for the trigger bar to move upward, wherein, when the slide moves forward, the slide causes the disconnector to move from the outward position to an inward position to a partially outward position, wherein the top surface of the protuberance of the disconnector mates with the bottom portion of inset portion of the trigger bar to prevent downward movement of the trigger bar, wherein continued forward movement of the trigger bar causes the top surface of the disconnector to disengage from the bottom portion of the inset portion of the trigger bar and causes the disconnector to move to a fully outward position to allow the cam surface of the trigger bar to reengage with the cam surface of the disconnector.

2. A disconnector trigger bar safety for a semi-automatic pistol, comprising:

(a) a trigger bar having a trigger end and a firing pin end, the firing pin end having a sear surface and a cam surface, the trigger bar having an inside surface disposed adjacent to the cam surface, (b) a disconnector moveable from an inward position to an outward position and back to an inward position, and having a cam surface to receive the cam surface of a trigger bar, (c) an inset portion on the trigger bar at the firing pin end, the inset portion having a bottom surface, (d) a protuberance on the at least one side of the disconnector to mate with the inset portion of the trigger bar, the protuberance having a top surface matable to the bottom surface of the inset portion, (e) wherein rearward movement of the trigger bar causes the cam surface of the trigger bar to slide against the cam surface of the disconnector to move the firing pin end of the trigger bar downwardly, (f) wherein the disconnector moves to provide clearance for the trigger bar to move upward, (g) wherein, the top surface of the protuberance of the disconnector mates with the bottom portion of inset portion of the trigger bar to prevent downward movement of the trigger bar, (h) wherein forward movement of the trigger bar causes the top surface of the disconnector to disengage from the bottom portion of the inset portion of the trigger bar and causes the disconnector to move to allow the cam surface of the trigger bar to reengage with the cam surface of the disconnector.

* * * * *